United States Patent [19]

Plumer

[11] 4,014,263

[45] Mar. 29, 1977

[54] CASELESS PROJECTILE

[75] Inventor: Roy D. Plumer, Santa Barbara, Calif.

[73] Assignee: The United States of America as represented by the Secretary of the Army, Washington, D.C.

[22] Filed: Feb. 23, 1976

[21] Appl. No.: 660,074

[52] U.S. Cl. ..... 102/38; 102/49.3; 102/DIG. 1

[51] Int. Cl.[2] ..... F42B 5/00

[58] Field of Search ..... 102/38, 39, 40, 49.1, 102/49.2, 49.3, 49.7, 93, DIG. 1

[56] References Cited

UNITED STATES PATENTS

| | | | |
|---|---|---|---|
| 1,602,037 | 10/1926 | Mixsell | 102/49.3 |
| 2,096,698 | 10/1937 | Lowy et al. | 102/39 |
| 2,399,398 | 4/1946 | Smith | 102/49.1 X |
| 3,233,505 | 2/1966 | Clas | 102/43 C |
| 3,862,599 | 1/1975 | Olsen | 102/49.3 X |

*Primary Examiner*—Harold Tudor
*Attorney, Agent, or Firm*—Nathan Wedelberg; A Victor Erkkila; Max Yarmovsky

[57] ABSTRACT

A high pressure vented toroidal shaped propellant chamber has an integrally attached primer assembly which communicates therewith by a tubular spoke element. The vented propellant chamber is affixed to the rear end of a projectile. The propellant, when ignited, generates gases in the vented toroidal chamber providing the propulsion force needed to forcibly expel the projectile from a launcher. The caseless projectile attains a proper muzzle velocity without the use of a conventional cartridge case.

4 Claims, 3 Drawing Figures

CASELESS PROJECTILE

GOVERNMENTAL INTEREST

The invention described herein was made in the course of a contract with the Government and may be manufactured, used and licensed by or for the Government for governmental purposes without the payment to me of any royalty thereon.

BACKGROUND OF THE INVENTION

Various means have been used in the prior art to propel a 30 mm. grenade type projectile from a gun. The prior art 30 mm "cased" system uses a typical high-low cartridge case. In the prior art device, a primer is struck which ignites a propellant contained in a small confined volume. This small volume allows the build-up of high pressure (7–10,000 psi.) to insure proper propellant burning. Since large-base-area heavy grenades require relatively low pressure for proper launch, the confined high-pressure gas generated by a propellant is released behind the grenade into a low pressure chamber through a series of orifices from a high pressure chamber. The problem with these prior art grenade launchers, which utilize a cartridge case having both high and low pressure chambers, is that they are inefficient for use in a hand carried weapon because of their excessive weight and size.

SUMMARY OF THE PRESENT INVENTION

The present invention relates to a caseless projectile which uses a toroidal-shaped high pressure chamber for burning the propellant in a launcher where the conventional high-low pressure arrangement is reversed. The present invention's elimination of the need of a cartridge case for launching a projectile from a hand held weapon provides for a saving in the overall length of the munition of approximately 30%, and a weight saving of approximately 12%. A corresponding cost saving is also indicated due to the reduced requirement for making a cartridge case. A further advantage of the present invention is the storage of the propellant in a sealed chamber, which completely isolates it from the contaminating effects of the ambient environment. Problems such as the propellant being ignited by a spark, impact or abrasion, are essentially eliminated. The propellant in the present invention is protected from all of the environmental problems normally encountered with a caseless ammunition design.

An object of the present invention is to provide a caseless high pressure chambered projectile which is capable of being fired from a hand held weapon.

Another object of the present invention is to provide a high pressure chambered projectile which eliminates a cartridge case and provides for an overall saving in the length of the munition of approximately 30%.

Another object of the present invention is to provide a high pressure chambered projectile which eliminates a cartridge case and provides for a weight saving in the munition amounting to approximately 12%.

Another object of the present invention is to provide a caseless high pressure chambered projectile which is less costly than prior art devices because of the elimination of the need for making a cartridge case.

A further object of the present invention is to provide a caseless projectile having its propellant sealed in a chamber which isolates it from the contaminating ambient environments normally encountered in the use of caseless ammunition.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRITPION OF THE PREFERRED EMBODIMENTS

Figure 1:
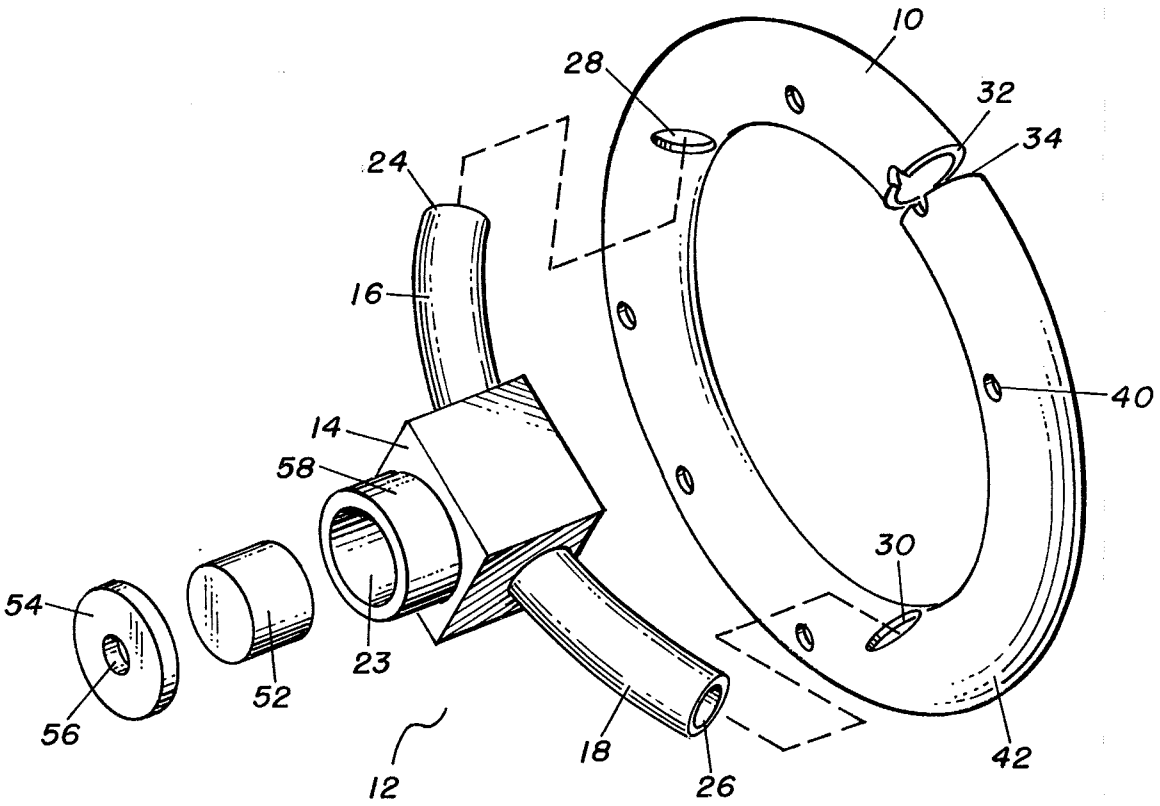
FIG. 1 is an exploded isometric view of the primer-propellant toroidal assembly.
Figure 3:
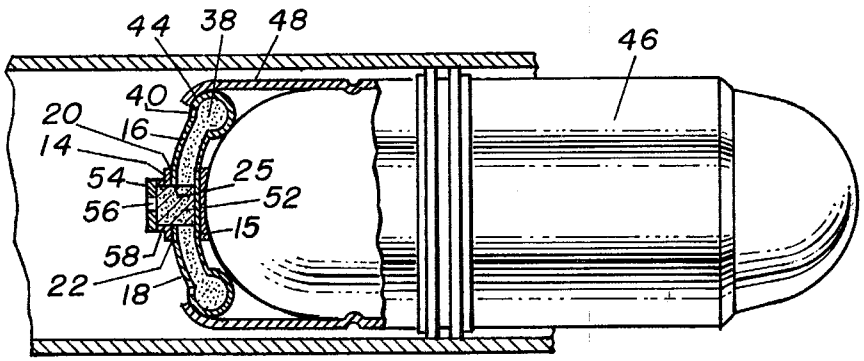
FIG. 3 is a partial diametral cross-sectional view taken along line 3—3 of FIG. 2 and a side view of FIG. 2.
Figure 2:
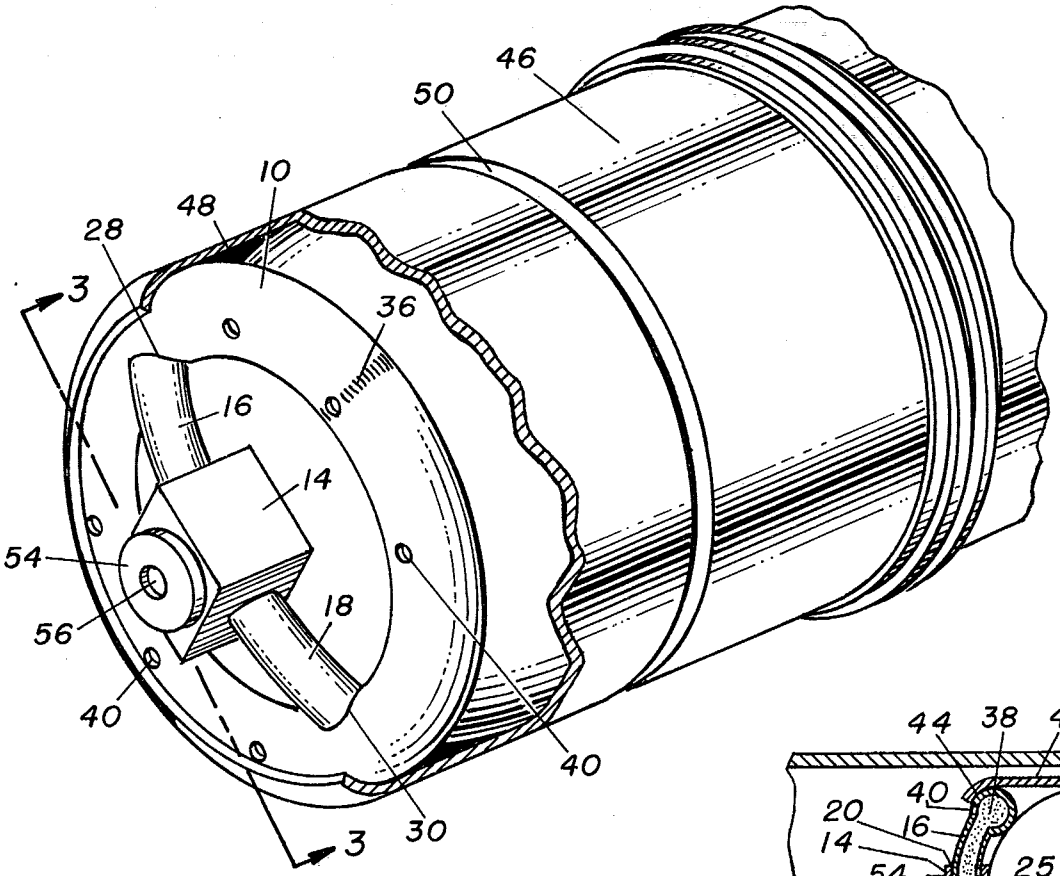
FIG. 2 is a partial cutaway isometric view of the primer-propellant assembly affixed to the rear end of a projectile.

Referring now to FIGS. 1–3 a toroidal shaped pressure chamber for burning a propellant is made of a hollow tubular material, such as 4130 steel, which is bent and cut into a C-shaped section 10. A center "spider" assembly 12 is made of a drawn cup 14 having a tubular member 15 which has two spokes 16 and 18 which radiate through cup holes 20 and 22 which are transversely positioned in cup 14 and communicate with axial bore 23 through hole 25. The ends 24 and 26 of spokes 16 and 18 respectively are aligned with a pair of chamber spoke holes 28 and 30 respectively, and are diametrically disposed in the inner wall of C-section tubular member 10. The tubing 10 is then bent to a closed position so that the spoke ends 24 and 26 engage the two holes 28 and 30 in toroidal tube 10. The tube C-section 10 is spot welded with ends 32 and 34 in abutment at weld seam 36 giving the tube 10 the necessary hoop strength to overcome the Bourdon tube effect when high pressure is developed within the toroidal chamber 10 during burning of the propellant 38. A plurality of gas vent orifices 40 are punched into the rear face 42 on the torus 10. The propellant 38 is loaded through these gas vent orifices 40. A dab of glue 44 is placed over each of the orifices 40 in order to prevent the propellant 38 from being lost or contaminated, such as by dampness. After the propellant 38 is loaded into the toroid 10 and the spokes 16 and 18, the assembly shown in FIG. 1 is attached to the grenade 46 by means of a cylindrical retaining sheath member 48. Sheath member 48 is staked to grenade 46 at grenade annular groove 50. A primer charge 52 is positioned within cup 14 and fixedly held therein by a disc shaped primer crimp member 54 having an axial striker hole 56 therein. Crimp member 54 is fixedly attached to the extended cup edge 58.

In operation, when the primer 52 is struck through strike hole 56, the primer ignites the propellant 38 located in spokes 16 and 18 and in the high pressure chamber 10. The gases generated in torus 10 at high pressure are vented through vent orifices 40 generating a low pressure in the launcher cavity 60 to the rear of the grenade 46 which is sufficient to propell the grenade 46 out of the launcher 62 at muzzle velocity which is compatible with a hand held weapon.

The foregoing disclosure and drawings are merely illustrative of the principles of this invention and are not to be interpreted in a limiting sense. I wish it to be understood that I do not desire to be limited to the exact details of construction shown and described for obvious modifications will occur to a person skilled in the art.

Having thus fully described the invention, what is claimed as new and desired to be secured by Letters Patent of the U.S. is:

1. A caseless high pressure chambered projectile which comprises:

a toroidally shaped hollow tubular chamber having a pair of diametrically disposed spoke holes located in the inner wall of said tubular chamber and a plurality of gas vent orifices positioned in the rear side of said tubular chamber;

a propellant material disposed in said tubular chamber;

means for covering the gas vent orifices of said tubular chamber after said propellant has been loaded in said tubular chamber, said means keeping said propellant sealed in said tubular chamber and free from ambient contamination when said projectile is in an unfired state;

spider means operatively positioned in said pair of spoke holes of said tubular chamber for igniting said propellant material located in said tubular chamber; and retaining sheath means for fixedly holding said integrally connected spider means and tubular chamber to said projectile so that said gas vent holes in said high pressure chamber are positioned to vent rearwardly of said projectile into a low pressure cavity of a launcher when said projectile is fired from said launcher.

2. A caseless high pressure chambered projectile as recited in claim 1 wherein said spider means comprises:

a primer;

a drawn cup having an axial bore and a transverse bore which communicates with said axial bore, said axial bore holding said primer therein;

a tubular member having a hole therein, said member fixedly positioned in the transverse bore of said drawn cup so that the hole in said tubular member is in axial alignment with the axial bore of said drawn cup, the ends of said tubular member being fixedly disposed in said spoke holes of said tubular chamber; and a disc shaped primer crimp member having an axial striker hole therein fixedly positioned over the axial bore of said drawn cup to retain said primer in said drawn cup.

3. A caseless high pressure chambered projectile as recited in claim 1 whherein said means for covering said gas vent orifices comprises a glue material.

4. A caseless high pressure chambered projectile as recited in claim 1 wherein said retaining sheath means comprises a hollow cylindrically shaped member having one end which abuts against the rear face of said toroidal chamber and the other end being staked into an annular groove located in said projectile.

* * * * *